US007108249B2

(12) United States Patent
Bechtel

(10) Patent No.: US 7,108,249 B2
(45) Date of Patent: Sep. 19, 2006

(54) T-POST EXTENDER AND HIGH FENCE SUPPORT

(76) Inventor: Friend K. Bechtel, 15902 E. Holcomb Rd., Mead, WA (US) 99021

( * ) Notice: Subject to any disclaimer, the term of this patent is extended or adjusted under 35 U.S.C. 154(b) by 64 days.

(21) Appl. No.: 10/789,202

(22) Filed: Feb. 27, 2004

(65) Prior Publication Data

US 2005/0189531 A1 Sep. 1, 2005

(51) Int. Cl.
*E04H 17/00* (2006.01)

(52) U.S. Cl. ..... 256/65.14; 256/1; 256/35; 256/DIG. 5; 256/32; 256/47

(58) Field of Classification Search ..... 256/1, 256/2, 11, 12, 21, 32, 34, 35, 47, 48, 57, 71; 411/533, 388, 389; 52/665, 719, 649.1, 736.1, 52/736.4; 403/270, 112, 117
See application file for complete search history.

(56) References Cited

U.S. PATENT DOCUMENTS

| | | | | |
|---|---|---|---|---|
| 697,259 | A * | 4/1902 | Lavely | 256/32 |
| 755,413 | A * | 3/1904 | Terry | 403/393 |
| 1,130,287 | A * | 3/1915 | Horvath | 256/24 |
| 3,370,834 | A * | 2/1968 | Reznicek | 256/10 |
| 4,598,906 | A * | 7/1986 | Sansbury | 482/17 |
| 5,395,093 | A | 3/1995 | Chrisman | |
| 5,461,364 | A * | 10/1995 | Sanford et al. | 340/541 |

OTHER PUBLICATIONS

MontGuide. Electric Fencing to Control Deer and Elk on Montana's Farms and Ranches, [Online], [retrieved on Sep. 13, 2004]. Retrieved from the internet <URL: http://www.Montana.edu/wwwpb/pubs/mt200010.html>.*

SARE, [Online], [retrieved on Oct. 14, 2005]. Retrieved from the Internet <URL: http://www.griffin.uga.edu/sare/twelve/grazing.html>.*

Talt. Battling Bambi, [Online], [retrieved on Oct. 14, 2005]. Retrieved from the Internet <URL: http://www.suite101.com/article.cfm/shade_gardening/106262>.*

Fickle, Just the FAQs, [Online], [retrieved on Oct. 14, 2005]. Retrieved from the internet <URL: http://www.ficklehillfence.com/faqs/html>.*

* cited by examiner

*Primary Examiner*—James R. Brittain
*Assistant Examiner*—Daniel J. Mills

(57) ABSTRACT

High fence supports can be expensive, difficult to ship, and awkward to install. Often, and particularly for the control of deer, it is desirable to increase the height of existing fence that uses steel T-posts for support. The T-post extender combined with a steel T-post becomes a high fence support useful for supporting high fence. A T-post extender consists of a longitudinal element, typically a length of steel rebar, and a stop element, typically a washer welded to the longitudinal element at a selected location along its length. For existing T-post fence supports, the T-post extender is slipped into place alongside the top of the T-post where it is captured laterally by existing wire ties and vertically by the stop element resting against the top of the T-post under the force of gravity. This arrangement has cost, installation, and shipping advantages both in new high fence construction and in the case where the height of existing T-post supported fence must be increased.

9 Claims, 4 Drawing Sheets

T-POST EXTENDER AND HIGH FENCE SUPPORT

FIELD OF INVENTION

This invention relates to an economical high fence support obtained by adding a T-post extender to a conventional steel T-post used for supporting agricultural, landscape, or privacy fence.

BACKGROUND OF THE INVENTION

Steel T-posts are often used to support fence such as woven or barbed wire in agricultural applications. In some cases, steel T-posts may be used to support other types of fence, e.g. landscape or privacy fence. Usually, the T-posts are hand-driven into the ground with a weighted steel sleeve, closed on one end and acting as a slide hammer. The result is a low-cost, easily-installed support for fence. Height of a T-post above the ground after being driven into place is typically about 5 ft (1.5 m) in agricultural applications for the control of livestock.

As rural construction on small acreage plots has increased, wild deer have proliferated due to fewer natural predators and hunting restrictions. These deer become emboldened and in many areas are a nuisance, as they eat and otherwise destroy vegetable gardens and plants near residences. Deer can easily jump over the typical agricultural fence. This specification discloses a T-post extender that, when used in combination with a T-post, increases the effective post height. By this means, the height of existing fence can be increased, and new high fence using T-posts and T-post extenders as fence supports can be constructed.

Prior Art

There is more than one prior art fence method to control deer. One method uses two parallel fences spaced a few feet apart, neither being particularly high. Deer do not like to jump one fence and land on another and so will be controlled by the parallel fence arrangement.

Another prior art method places a high voltage electric wire parallel to and outside an existing agricultural fence. Deer coming within jumping range of the agricultural fence will brush against the electric wire and not jump the fence. An electric fence by itself is usually not sufficient because deer will often run right through and destroy it, thereby requiring it to be periodically maintained.

Another prior art method uses a footing obstacle outside an existing fence. For example, the footing obstacle could be slatted wood pallets laid on the ground outside the fence. Deer avoid the pallets because their feet slip between the slats.

These prior art methods waste the real estate between the parallel fences in the first case, between the electric wire and fence in the second case, and over the width of the footing obstacle in the third case. The extra material cost can be significant where parallel fences or a footing obstacle is used. If the high voltage electric wire method is used, there is added cost and maintenance required to ensure that power is applied.

The most obvious prior art method increases the height of the fence to a level that prevents deer from jumping over. This is accomplished by using posts of a sufficient length to support the higher fence. T-posts of length 10 ft (3.05 m) are available for this. While some of this length will be in the ground, a fence height of 8 ft (2.44 m) can be achieved, and that will control deer in most circumstances. Alternatively, long wood or concrete posts may be used.

Further Discussion of Prior Art Using Long Posts

Although long T-posts can be purchased to support fence high enough to control deer, they are costly, and it is difficult to drive them without a ladder or something to stand on. Other types of posts, such as wood or concrete posts of sufficient length also are costly and are more difficult to install.

The cross-section of a steel T-post is in the shape of the letter T, and the cross section is designed so that the post will withstand bending moments applied by livestock that may lean or push against the fence. These applied moments are largest near the ground level of a post and decrease with distance upward along the post. A T-post has a cross-section along its length that is approximately uniform, and thus its moment restraint capability is approximately constant along its length. In a long steel T-post, this is wasteful of steel because applied moments in the upper part of the post are much less than the moment restraint capability there.

T-posts longer than about 7.5 ft (2.29 m) will not fit crosswise in most ocean-going containers. Thus, long posts can have a shipping disadvantage.

In many situations, fence supported by T-posts is already in place. To increase its height requires either the replacement of the existing T-posts with longer ones or the addition of longer posts as well as the installation of additional fence material.

Objectives and Advantages of the T-Post Extender and T-Post Combination

For existing T-post supported fence, the T-post extenders of this specification are added to the existing posts thereby increasing their support heights. The T-post extenders are simply slipped into place, and the additional fence is tied or wired on for the required fence height. This is a fast and low cost way to increase the fence height.

Where new fence is required, T-posts of manageable length are driven into the ground, and fence is tied or wired to the posts. Then T-post extenders are slipped onto the T-posts, the combinations thus forming high fence supports. Additional fence is tied or wired on to the high fence supports to obtain the required fence height. In some cases, the T-post extenders are installed first to form the high fence supports before installing any fence. The T-post extenders use less steel than the additional steel that would have been required had longer steel T-posts been purchased. Hence, the high fence support combination of a T-post extender plus a T-post can be less than the cost of a longer T-post.

Both T-posts for use with extenders and T-post extenders may be shipped either crosswise or lengthwise in an ocean-going container. Hence, there is a shipping advantage.

The idea for the present specification came as a result of the following experience. The inventor fenced an area of about 4 acres (1.6 hectares) around his home to keep deer out of a garden and away from landscape plantings. The fence comprised 8-ft (2.44 m) steel T-posts for supports, 47 inch (1.19 m) woven wire and three strands of barbed wire spaced above the woven wire to give a fence height of about 6 ft (1.83 m). The T-posts were easily driven to a depth below ground of about 18 inch (0.46 m) using a hand-operated T-post driver. For a short time, this fence kept the deer out. However, they soon learned the fence could be jumped, and deer were frequently seen inside the fenced area.

It was discovered that a 4-ft (1.22 m) length of ½ inch (13 mm) diameter steel reinforcing bar (rebar), manufactured for concrete reinforcing and left over from a building project, would fit alongside a vertical T-post and be captured laterally by wire ties that attached the existing fence wire to the T-post. A ½ inch steel flat washer, when fitted over the rebar and welded into position about 18 inch (0.46 m) from its lower end, rested on top of the T-post and prevented the rebar from sliding further downward along the T-post. This left about 30 inch (0.76 m) of the rebar extending upward from the top of the T-post, thereby extending the effective height of the T-post by that amount. The rebar with welded on washer became an example of a T-post extender, and in combination with a T-post, became a high fence support.

A T-post extender was inserted at the top of each of the existing T-posts, and an angle iron height extender was bolted on each of the wood corner posts and posts at gate ends to extend their heights. Two additional barb wires were wired onto the T-post extenders giving a total fence height of about 8 ft (2.44 m). The T-post extenders as described allow additional barb wires to be added if necessary to a height of about 9 ft (2.74 m). It has been found that deer are reluctant to jump the 8-ft fence. However, they can jump it, as seen on occasion when a gate is left open. Deer come through the open gate, and in the process of being chased out, they will jump the fence.

On rare occasions, deer will force their way between fence wires. This can be prevented with additional, more closely spaced wires or by using a second tier of 47 inch (1.19 m) woven wire fence tied to the upper parts of the high fence supports.

Summary of Advantages of T-Posts and T-Post Extenders for High Fence Supports.

Height of existing T-post supported fence may be increased easily.

For existing T-post supported fence, adding T-post extenders is the least costly way to increase fence height.

New high fence is most easily constructed by using T-post extenders with manageable length T-posts and is less costly than alternatives.

This type of high fence support is less wasteful of materials than alternatives.

T-posts with T-post extenders have shipping advantages.

SUMMARY OF THE INVENTION

A T-post extender comprised of a longitudinal support element and a stop element is inserted into place alongside the top of a T-post and is captured there laterally by wire ties that attach upper wires of the fence to the T-post. The T-post extender is captured vertically by the stop element which rests against the top of the T-post and prevents the T-post extender from moving downward under gravitational force. The combination of T-post and T-post extender in place is the specified high fence support.

DETAILED DESCRIPTION OF THE PREFERRED EMBODIMENT

The preferred embodiment described here is a realization of the T-post extender and high fence support proven to function as intended.

Figure 1:
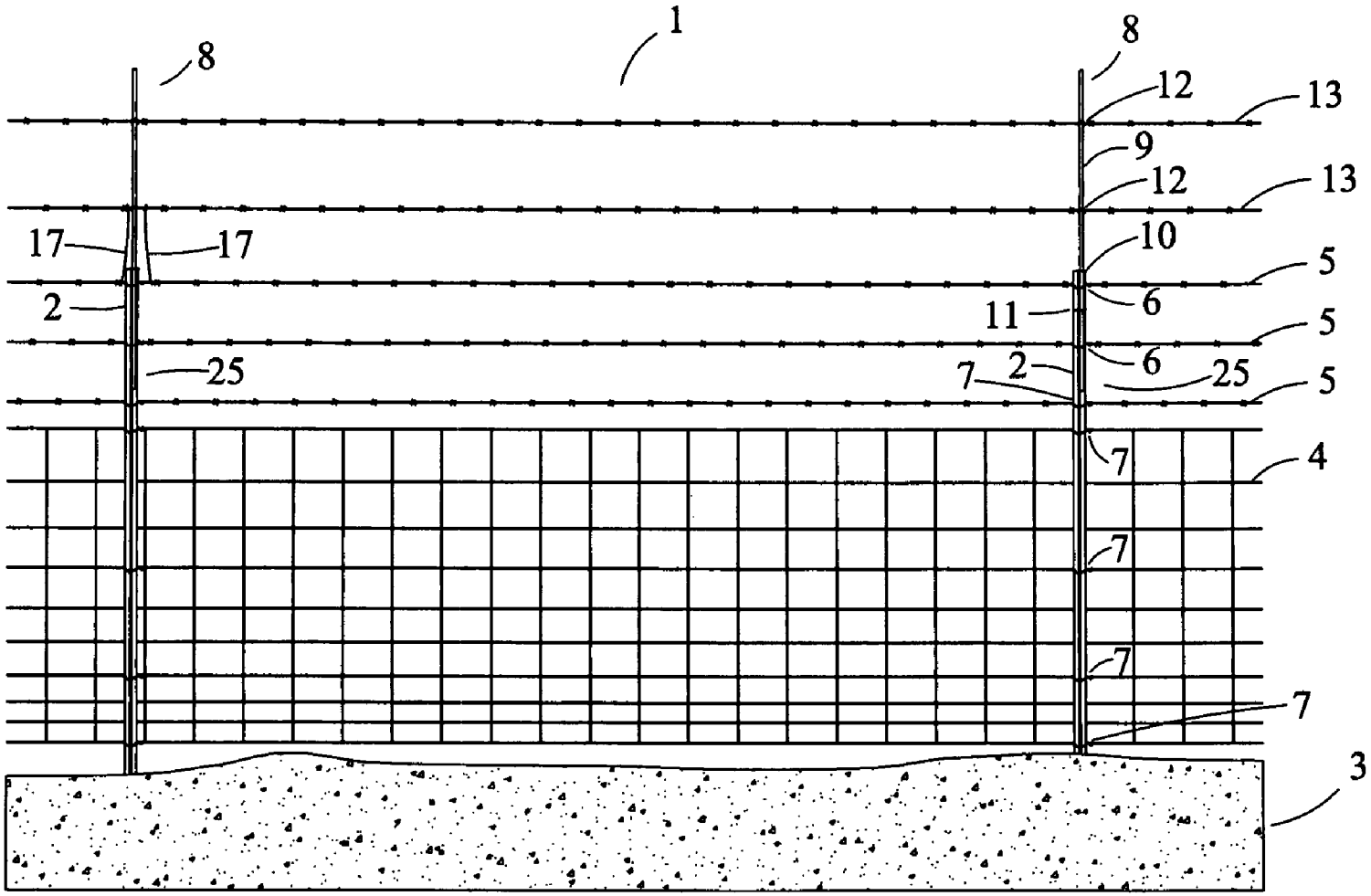
FIG. 1, illustrating the environment in which T-post extenders and high fence supports are applicable, is an elevation view showing a length of high fence using high fence supports to support the fence.

FIG. 1 shows a length of fence 1 that is supported by two identical high fence supports 25 each comprised of a steel T-post 2 and T-post extender 8. The T-posts have been driven into the ground 3. A 47 inch (1.19 m) width of woven wire 4 and three barb wires 5 are shown tied to the T-posts with wire ties 6 and 7 of the type customarily supplied when T-posts are purchased. Some additional detail of the upper part of a high fence support 25 is shown in FIG. 3A.

Figure 3A:
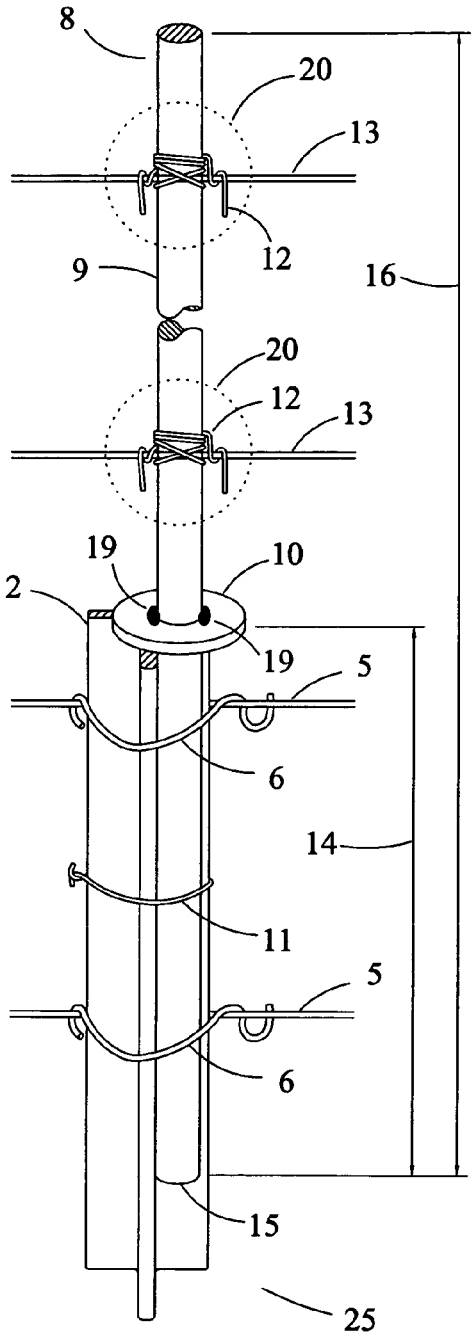
FIG. 3A is a view of the upper part of a high fence support and includes a T-post extender in position at the top of a T-post, as well as illustrating fence wires attached to the high fence support.

Referring to FIG. 1 and FIG. 3A, a T-post extender 8 is shown slipped into place alongside the top part of each T-post 2. Each T-post extender is comprised of a longitudinal element 9 and a stop element 10 fixed to the longitudinal element at a specified position from the lower end 15 of the longitudinal element. Wire tires 6 that attach one or more of the upper fence wires 5 to the T post 2 also constrain the T-post extender 8 laterally against the upper part of the T-post. At least one wire tie 6 is needed for this lateral support. If fence wires 5 are not yet tied to the T-post so that there is no upper fence wire 5 with wire tie 6 that is suitable for this purpose, then a simple wire tie 11 about the upper part of the T-post 2 will be temporarily sufficient until such fence wires 5 are installed. Stop element 10 fixes the vertical position of the T-post extender 8 and prevents it from sliding under the force of gravity further down alongside the T-post 2. Additional fence wires 13, shown in FIG. 1 as barb wires, are tied to the T-post extenders 8 with wire wraps 12, thereby completing the resulting high fence.

In exceptional cases, especially where the ground has a pronounced dip in the vicinity of a T-post, tension in the wires 13 will tend to lift the T-post extender 8 up and away from its position where the stop element 10 rests on top of the T-post 2. In these cases, the T-post extender can be restrained in position with one or more wire ties 17. In FIG. 1, two wire ties 17 hold the lower one of barb wires 13 in place relative to the upper one of barb wires 5 in the vicinity of a high fence support 25. In FIG. 1, each of the wire ties 17 consists of a length of 14 gauge galvanized wire wrapped at its one end around the lower one of barb wires 13 and at its other end around the upper one of barb wires 5. Because wires 13 and 5 are tied respectively to a T-post extender 8 and a T-post 2 by wire wrap 12 and wire tie 6 respectively, the wire ties 17 prevent the T-post extender from lifting up from the top of its T-post.

Figure 2A:
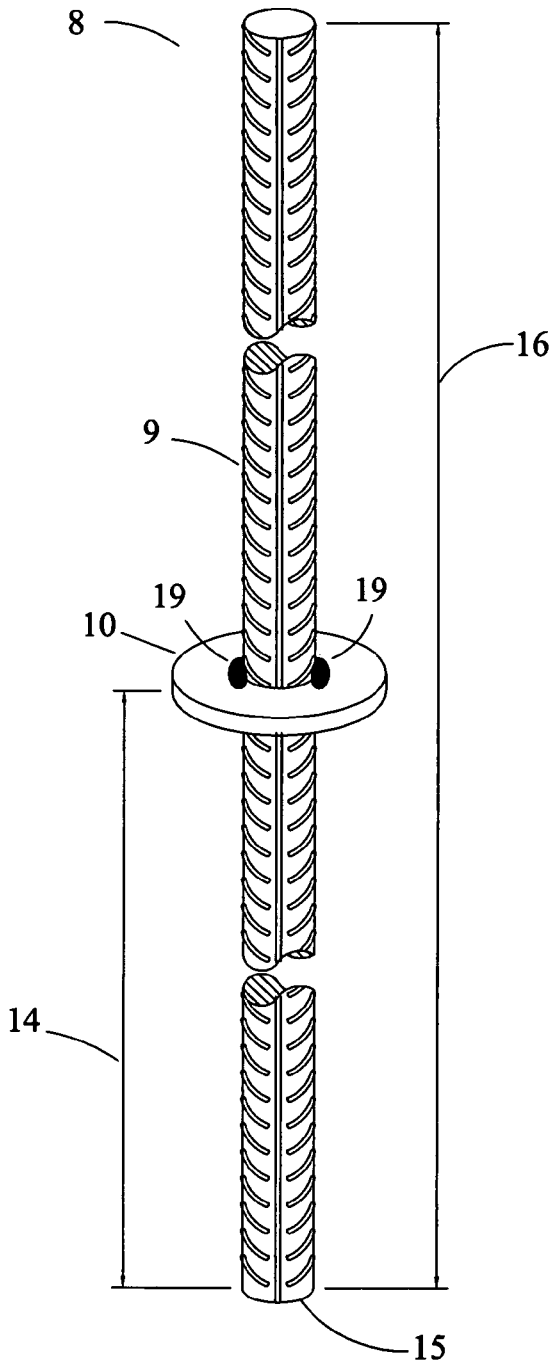
FIG. 2A illustrates a T-post extender with two lengths removed from its longitudinal element for decreased drawing scale. A welded attachment of the stop element to the longitudinal element is shown.

Construction detail of a T-post extender is illustrated in FIG. 2A. The longitudinal element 9 is shown with two lengths removed to allow a drawing scale where detail may be seen. In this embodiment, the longitudinal element 9 is a 4-ft (1.22 m) length 16 of ½ inch (13 mm) diameter steel reinforcing bar (rebar) customarily used to reinforce concrete. Either 40 or 60 grade rebar may be used. In the case of ½ inch 40 grade rebar, the moment restraint capability is almost 500 lb-in (56 nt-m); or with 60 grade, almost 750 lb-in (85 nt-m). While this has been proved sufficient, it is reasonable that moment restraint capability as low as 200 lb-in (23 nt-m) may be useful in some cases, where ⅜ inch (10 mm) diameter rebar could be used as the longitudinal element.

The stop element 10 for the preferred embodiment is a steel washer having internal diameter just large enough so that it may be slipped over the longitudinal element 9 and welded to it at a distance 14 from a first end 15. In this embodiment, the distance 14 is 18 inch (0.46 m). A ½ inch steel flat washer has been found satisfactory for use as the stop element. Care should be taken that not too much heat is applied in the attachment by welding of the stop element to the support element, especially in the case where 60 grade rebar is used, as that could cause the rebar to become brittle over too large a region. The use of 40 grade rebar will alleviate this potential difficulty, but 40 grade rebar is not as strong as 60 grade (see numbers above). It has been found that light welds 19 applied at a pair of diametrically opposite points about the rebar to anchor the washer 10 to the rebar 9 will give satisfactory results with either 40 or 60 grade rebar.

Referring now to FIG. 3A as well as FIGS. 1 and 2A, the length 14 from the first end 15 to the stop element 10 is sufficient so that the T-post extender may be laterally captured alongside the upper part of a T-post 2 by wire ties 6 and possibly 11 as previously discussed. Only the upper part of the T-post is shown in FIG. 3A. In the preferred embodiment, the length 14 is 18 inch (0.46 m), which is long enough that wire ties 6 for the upper two of wires 5 (refer to FIG. 1 and FIG. 3A) laterally capture the T-post extender 8. The remaining length of the longitudinal element 9 is the effective increase in fence support height caused by the T-post extender. In the case of the preferred embodiment, this remaining length is 30 inch (0.76 m), which is the length 16 of the longitudinal element 9 minus the length 14. The length 16 of the longitudinal element was chosen to be 48 inch (1.22 m) because, with no scrap, that allowed five longitudinal elements to be cut from a standard 20 ft (6.10 m) length of rebar and a satisfactory (30 inch) height extension.

When used with an 8-ft (2.44 m) T-post with 18 inch (0.46 m) in the ground, the combination of T-post and T-post extender yields a high fence support extending 9 ft (2.74 m) above the ground. If a 7.5 ft (2.29 m) T-post were used, the high fence support would be 8.5 ft (2.59 m) above the ground. Either height is usually sufficient to control deer.

In new fence situations where steel T-posts and T-post extenders are to be installed before fastening any fence to the supports, it will be useful to add one or more simple wire ties 11 to laterally support each T-post extender in place alongside the top of each steel T-post (refer to FIG. 1 and FIG. 3A). The fence can then be wire-tied to the high fence supports (combination of T-posts and T-post extenders).

Figure 3B:
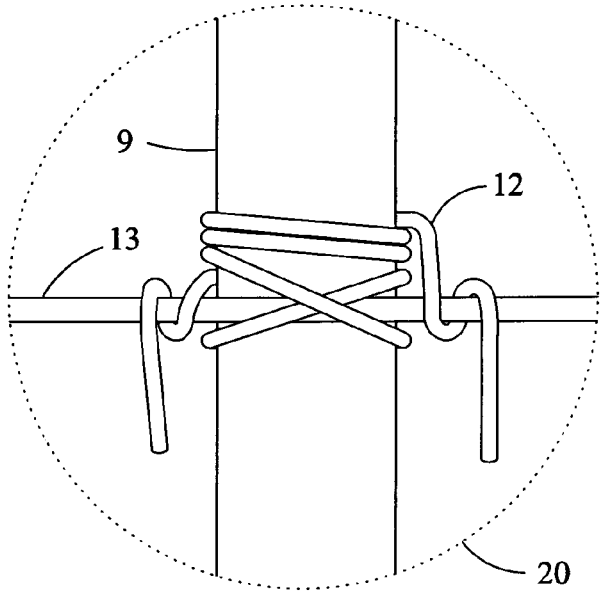
FIG. 3B is an elevation view showing detail contained in the dotted circular areas of FIG. 3A. Wire wrap attachment details of a fence wire to a T-post extender are clearly illustrated.
Figure 4A:
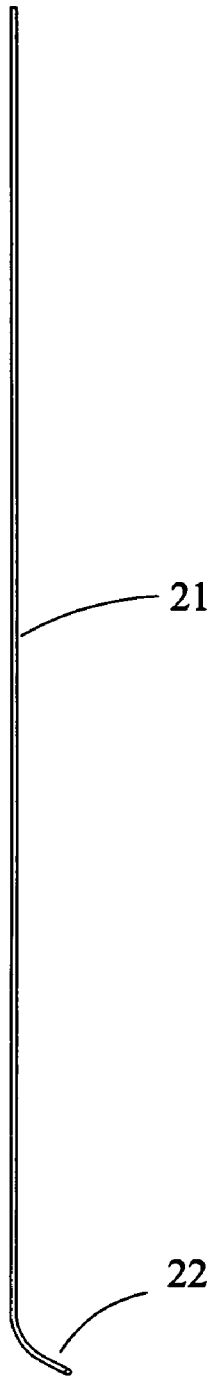
FIGS. 4A and 4B are two views of an efficient cut wire shape for a wire wrap used to attach a fence wire to the longitudinal element of a T-post extender.
Figure 4B:
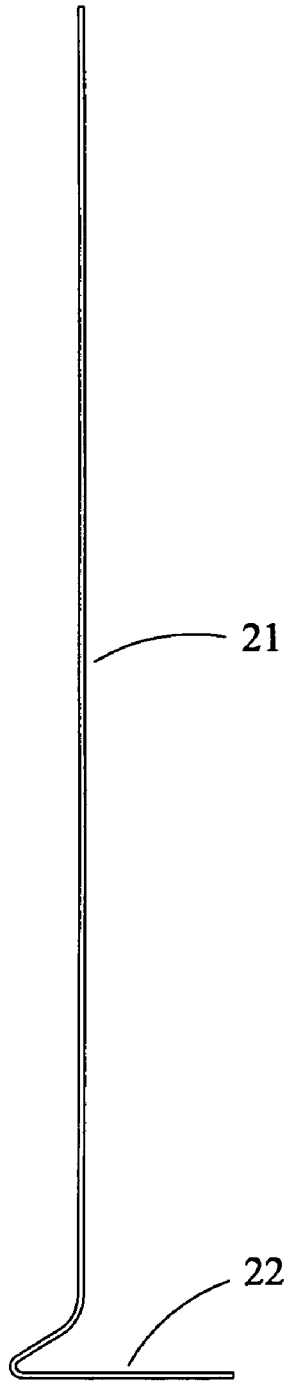

A number of wire tie arrangements can work to tie fence to the T-post extenders. One method is the wire wrap 12 illustrated in FIG. 1 and FIG. 3A, with expanded view in FIG. 3B. Wire wrap 12 as detailed in FIG. 3B is efficiently applied and has been found satisfactory in preventing vertical slippage of fence wires 13 along the longitudinal elements 9 of the T-post extenders. Wire for the wire wraps 12 can be carried as a roll and short lengths cut and applied as an installer moves along a fence. More efficiently, wire may be pre-cut and bent as in the shape of the two views of FIGS. 4A and 4B. In attaching a fence wire, the installer hooks the hooked end 22 of the wire 21 of FIGS. 4A and 4B onto a fence wire 13 and then wraps it around the longitudinal element 9 of the T-post extender 8 following the pattern illustrated in FIG. 3B. In the preferred embodiment, total wire length for the wire 21 of FIGS. 4A and 4B is about 15 inch (0.38 m). Galvanized, 14 gauge wire has been found satisfactory for this purpose.

Although ½ inch rebar and ½ inch washer for the longitudinal and stop elements respectively have proved satisfactory, other rebar and washer sizes may be used. As diameter of the rebar increases, both its strength and cost increase. There is no evidence that larger sizes than ½-inch diameter rebar are useful. Referring to FIG. 3A, it can be seen that the available space along the upper part of a T-post 2 between it and a wire tie 6 is limited. The ½-inch size rebar fits well, but larger sizes can require loosening the wire ties 6 to allow the T-post extender to slip into place. Smaller size rebar is not as strong as ½-inch rebar, but in some cases may be a preferred choice because of its lower cost. In that event, the stop element is sized to match. The length of the longitudinal element and the desired position of the stop element along the longitudinal element may be selected differently for different situations.

It is not necessary that rebar be used as the longitudinal element. All that is required is a longitudinal element that can be inserted adjacent a T-post, be captured laterally by wire ties, and adequately resist applied bending moments. Neither is it necessary that a round flat washer be used as the stop element. Any stop element that can be attached to the longitudinal element to prevent it from sliding down alongside a T-post can be used.

Figure 2B:
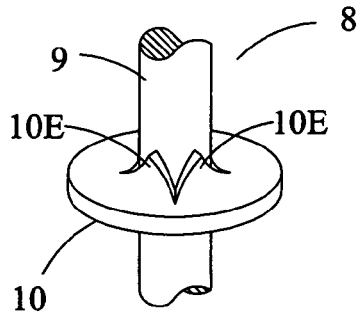
FIG. 2B shows a stop element that has been pressed onto the longitudinal element of a T-post extender.

The preferred embodiment attaches the stop element to the longitudinal element by welding. Any attachment means is acceptable that will cause the stop element to be maintained at a desired position along the longitudinal element. For example, another means of attaching the stop element to the longitudinal element is by crimping the stop element to the longitudinal element. In FIG. 2B, a stop element 10 formed from a disc shaped piece of steel has had cross slots cut in its center area, and then the disc has been pressed into place along the longitudinal element 9. Crimping of the resulting bent portions 10E of the disc down toward the plane of the disc and against the longitudinal element 9 may or may not be required depending on the circumstances.

Figure 2C:
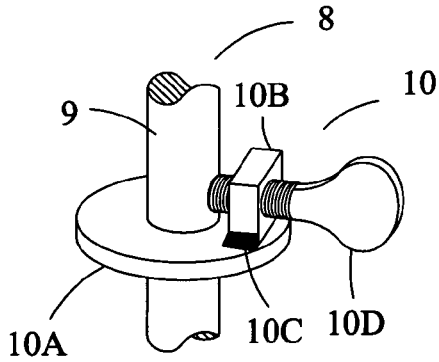
FIG. 2C shows an adjustable stop element in a selected position along the longitudinal element of a T-post extender.

In some cases it may be useful to make the position of the stop element along the longitudinal element adjustable. That can be accomplished, for example, with a stop element that is held in place along the longitudinal element by adjustable attachment means. FIG. 2C shows part of a T-post extender 8 with a stop element 10 comprised of a washer A with a threaded nut B fixed to it by weld C and a thumb screw D for tightening against the longitudinal element 9. By this means, the effective height of the T-post extender (length 16 minus length 14 in FIG. 2A and FIG. 3A) is adjustable.

Figure 2D:
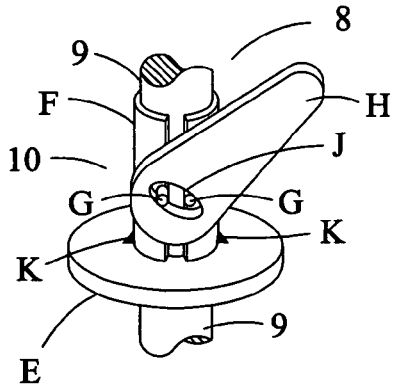
FIG. 2D shows an alternative adjustable stop element attached to the longitudinal element of a T-post extender.

An alternative adjustable stop element is shown in FIG. 2D. In this arrangement the stop element 10 is comprised of a washer E, a split sleeve F having protrusions G that are integral with the split sleeve F, and an over-centering lever H with elongated oval-shaped hole J. The split sleeve F is welded to washer E at K. When over-centering lever H is rotated clockwise, the periphery of its oval-shaped hole J acts against the protrusions G and urges the sleeve F to tighten against the longitudinal element 9 of the T-post extender 8. The geometry is arranged so that maximum tightening of sleeve F occurs just before lever H completes its maximum clockwise rotation and comes to rests against washer E. Instead of lever H and protrusions G, a simple hose clamp, readily available at any automotive parts store, can be slipped over the sleeve F and tightened. Either the hose clamp or the over-centering lever arrangement will tighten the sleeve F against the longitudinal element 9 and fix the stop element 10 to the longitudinal element 9.

In compliance with the statute, the invention has been described in language more or less specific as to its features. The invention is not limited to the specific features shown, because the means and construction herein disclosed comprise a preferred form of putting the invention into effect. The invention is, therefore, claimed in any of its forms or modifications within the proper scope of the appended claims appropriately interpreted in accordance with the doctrine of equivalents.

The invention claimed is:

1. A high fence support comprising:

a T-post extender comprising an elongated longitudinal element having a longitudinal axis and an exterior surface that is substantially a cylinder, the longitudinal axis being defined as the locus of points that are the centroids of all cross sections of the longitudinal element, the maximum extent of any cross section measured from its centroid to any point on the periphery of the cross section being about ¼ inch, the longitudinal element being able to withstand bending moments in any direction perpendicular to the longitudinal axis of at least 200 pound-inch, the T-post extender comprising also a single stop element surrounding the longitudinal element, the stop element in a selected position along the longitudinal element, the selected position being relative to a first end of the longitudinal element, the stop element having maximum extent in the longitudinal axial direction of less than about 2 inches, and, when the stop element and a straight line that is a linear least squares fit to the longitudinal axis in the region of the stop element are projected onto any plane having a normal perpendicular to the straight line, the stop element at substantially its end in the longitudinal direction nearest the first end of the longitudinal element has a projected profile that extends at least ½ inch in each of the two radially opposed directions measured from the projected straight line, the T-post extender stop element having an attachment means for fixing the stop element to the longitudinal element at the selected position; and a steel T-post with one or more wire ties, the steel T-post having an upper end and having cross sections substantially in the shape of a T, the T having a stem and an over-bar, one end of the stem of the T meeting the over-bar of the T at its center and at substantially right angles, the steel T-post having one or more wire ties each on the T-post at substantially a cross section of the T-post near its upper end, each wire tie either completely surrounding the T-post or in combination with existing fence wire completely surrounding the T-post, the interstitial space between the T-post and each wire tie formed by the stem of the T, the over-bar of the T, and the wire tie being sufficient to accept the first end of the T-post extender longitudinal element; wherein the T-post extender is secured onto the T-post within the interstitial spaces between the T-post and wire ties, the T-post extender being held laterally by the wire ties, the T-post extender in position alongside the upper part of the T-post and held vertically by gravity, wherein a lowermost surface of the T-post extender stop element is in contact with the top most surface of the T-post, such that the T-post extender is held vertically against gravity and a portion of the T-post extender extends above the T-post.

2. The T-post extender of claim 1 wherein the longitudinal element is a length of steel rebar, the stop element is a steel flat washer, and the attachment means for fixing the stop element to the longitudinal element at the selected position is by welding the flat washer to the rebar.

3. The T-post extender of claim 2 wherein the rebar is ½ inch diameter, and the steel flat washer has an interior diameter of about ½ inch that is sufficient for the steel flat washer to slide over the rebar into position for attachment by welding.

4. The T-post extender of claim 1 wherein the attachment means for fixing the stop element to the longitudinal element is adjustable, whereby the stop element may be fixed to the longitudinal element at a position along the longitudinal element and then reset later to another position.

5. The T-post extender of claim 4 wherein the adjustable attachment means is part of the stop element.

6. The T-post extender of claim 5 wherein the adjustable attachment means includes a thumbscrew.

7. The T-post extender of claim 5 wherein the adjustable attachment means includes an over-centering clamp type device that tightens a sleeve against the longitudinal element.

8. The T-post extender of claim 1 wherein the longitudinal element is a length of steel rebar, the stop element is a piece of flat steel having a face and having cross slots cut through said face in substantially the center of said face and attached to the longitudinal element by pressing it to the desired location along the longitudinal element.

9. The T-post extender of claim 8 wherein the attachment of the stop element to the longitudinal element includes a crimping operation.

* * * * *